US006114105A

United States Patent [19]

Brust et al.

[11] Patent Number: 6,114,105

[45] Date of Patent: Sep. 5, 2000

[54] HIGH BROMIDE TABULAR GRAIN EMULSIONS WITH EDGE PLACEMENT OF EPITAXY

[75] Inventors: Thomas B. Brust, Webster; Bernard D. Stich, North Chili, both of N.Y.

[73] Assignee: Eastman Kodak Company, Rochester, N.Y.

[21] Appl. No.: 09/290,940

[22] Filed: Apr. 13, 1999

[51] Int. Cl.[7] ..... G03C 1/035; G03C 1/09

[52] U.S. Cl. ..... 430/567; 430/603; 430/605

[58] Field of Search ..... 430/567, 569, 430/603, 605

[56] References Cited

U.S. PATENT DOCUMENTS

| | | | |
|---|---|---|---|
| 4,435,501 | 3/1984 | Maskasky | 430/434 |
| 5,011,767 | 4/1991 | Yamashita et al. | 430/567 |
| 5,494,789 | 2/1996 | Daubendiek et al. | 430/567 |
| 5,503,970 | 4/1996 | Olm et al. | 430/567 |
| 5,503,971 | 4/1996 | Daubendiek et al. | 430/567 |
| 5,573,902 | 11/1996 | Daubendiek et al. | 430/567 |
| 5,576,168 | 11/1996 | Daubendiek et al. | 430/567 |
| 5,576,171 | 11/1996 | Olm et al. | 430/567 |
| 5,582,965 | 12/1996 | Deaton et al. | 430/567 |
| 5,612,175 | 3/1997 | Eshelman et al. | 430/567 |
| 5,612,176 | 3/1997 | Eshelman et al. | 430/567 |
| 5,612,177 | 3/1997 | Levy et al. | 430/567 |
| 5,614,359 | 3/1997 | Eshelman et al. | 430/567 |

OTHER PUBLICATIONS

J.E. Maskasky "Epitaxial Selective Site Sensitization of Tabular Grain Emulsions" *Journal of Imaging Science*, vol. 32, No. 4, Jul./Aug. 1988.

*Primary Examiner*—Mark F. Huff
*Attorney, Agent, or Firm*—Andrew J. Anderson; Carl O. Thomas

[57] ABSTRACT

A high bromide {111} tabular grain emulsion is disclosed in which most of the tabular grains exhibit silver salt epitaxy at a single site. Most of the silver halide epitaxy sites contact an edge region of the tabular grains. These emulsions exhibit chemical sensitization by the epitaxy and surprising lower levels of desensitization by spectral sensitizing dyes.

12 Claims, 1 Drawing Sheet

5 μm

5 μm

HIGH BROMIDE TABULAR GRAIN EMULSIONS WITH EDGE PLACEMENT OF EPITAXY

FIELD OF THE INVENTION

The invention relates to silver halide photography. More specifically, the invention relates to sensitized tabular grain silver halide emulsions

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "{111} tabular" in referring to grains and emulsions indicates those in which the tabular grains have parallel major crystal faces lying in {111} crystal planes.

The terms "high bromide" and "high chloride" in referring to grains and emulsions indicates that bromide or chloride, respectively, is present in a concentration greater than 50 mole percent, based on total silver.

In referring to silver halide grains and emulsions containing two or more halides, the halides are named in order of ascending concentrations.

The term "epitaxy" indicates a first crystal lattice structure that derives its orientation from a second, differing (host) crystal lattice structure on which the first crystal lattice structure is grown.

The term "edge region" is employed to indicate that portion of a silver halide grain that lies within 0.2 $\mu$m of an edge of the grain.

The term "surface region" indicates the 40 percent portion of a silver halide grain, based on silver, that lies nearest the surface of the grain.

The term "coprecipitated" indicates that the grains were formed in the same reaction vessel during a batch precipitation or, in a continuous precipitation, formed by passing through the same reaction vessel operated at a steady state (invariant) set of operating conditions.

Pluronic 31R1 is the BASF trademark for $$HO—[CH(CH_3)CH_2O]_x—(CH_2CH_2O)_y—[CH_2(CH_3)CHO]_{x'}—H$$

where x=25, x'=25 and y=7.

*Research Disclosure* is published by Kenneth Mason Publications, Ltd., Dudley House, 12 North St., Emsworth, Hampshire P010 7DQ, England.

BACKGROUND OF THE INVENTION

Joe E. Maskasky, "Epitaxial Selective Site Sensitization of Tabular Grain Emulsions", *Journal of Imaging Science*, Vol. 32, No. 4, July/August 1988, and Maskasky U.S. Pat. No. 4,435,501 report investigations of the epitaxial deposition of silver halide (typically high chloride) salts on high bromide tabular grains. In most of the tabular grain emulsions, the epitaxy is present at a number of sites on the host tabular grains. In most of these emulsions the epitaxy lies at multiple sites along the edges of the tabular grains, ranging from an almost continuous edge band to sites confined to the corners of the grains. Maskasky in FIG. 10 (article) and FIG. 21 (patent) discloses single site epitaxy confined to the center of the host tabular grains. Single site deposition was accomplished by forming the central portion of the host tabular grains of silver bromide and growing the laterally surrounding region to contain 12 mole percent iodide, based on silver.

Levy U.S. Pat. No. 5,612,177 is an improvement on Maskasky that shows a performance advantage for growing the silver salt epitaxy as terraces extending inwardly from the edges of host high bromide {111} tabular grains. Single site epitaxy is not disclosed.

Illustrations of silver halide epitaxy at the corners of high bromide ultrathin {111} tabular grains are provided by Daubendiek et al U.S. Pat. Nos. 5,494,789, 5,503,971 and 5,576,168, and Deaton et al U.S. Pat. No. 5,582,965.

Eshelman et al U.S. Pat. No. 5,612,175 illustrates silver halide epitaxy on high bromide {111} tabular grains, with the epitaxy being limited to less than 5 percent of total silver. Eshelman et al U.S. Pat. Nos. 5,612,176 and 5,614,359 illustrate silver halide epitaxy on high bromide {111} tabular grains that have an average ECD of greater than 10 $\mu$m.

PROBLEM TO BE SOLVED

When a silver halide photographic element is imagewise exposed, latent image formation results from the absorption of photon energy. Each absorbed photon produces a hole and a conduction band electron. The conversion of several silver ions ($Ag^+$) to elemental silver ($Ag^\circ$) at one location within a silver halide grain is required to render a grain developable.

It has been postulated that a significant advantage of relying on the selective siting of silver halide epitaxy in chemical sensitization is that selective siting reduces the competition among sites for the minimum number of conduction band electrons required to form a latent image. Thus, an ideal siting of silver halide epitaxy would seem to be at a single site on a host tabular grain. Further, to increase the chance of a conduction band electron migrating to the single site, a central location on the host tabular grain for the single site would seem theoretically ideal.

In fact, a plurality of silver halide epitaxy sites are present in the most successful high bromide {111} tabular grain emulsions employing silver halide epitaxy in sensitization. In most instances in preparing these emulsions adsorbed spectral sensitizing dye and/or surface region iodide levels of at least 8 mole percent, based on silver have been relied upon for the siting of the epitaxy.

SUMMARY OF THE INVENTION

It has been discovered quite unexpectedly that the performance efficiency of high bromide {111} tabular grain emulsions having epitaxy confined to a single site on most host tabular grains can be increased by locating the epitaxy site in contact with an edge region of the tabular grain.

In one aspect, this invention is directed to an emulsion comprised of high bromide silver halide grains and a dispersing medium, tabular silver halide grains having {111} major faces accounting for greater than 50 percent of total grain projected area, any iodide at the major faces of the tabular grains being uniformly distributed and any iodide in a surface region accounting for 40 percent of total silver amounting to less than 7 mole percent, based on silver in the surface region, greater than 50 percent of the tabular grains serving as a host for silver halide epitaxy at a single site on the host tabular grains, the silver halide epitaxy contains a chloride content that is at least 10 mole percent higher than that of the host tabular grains, and greater than 50 percent of the silver halide epitaxy sites contacting an edge region of the host tabular grains.

DETAILED DESCRIPTION OF THE INVENTION

Figure 1:
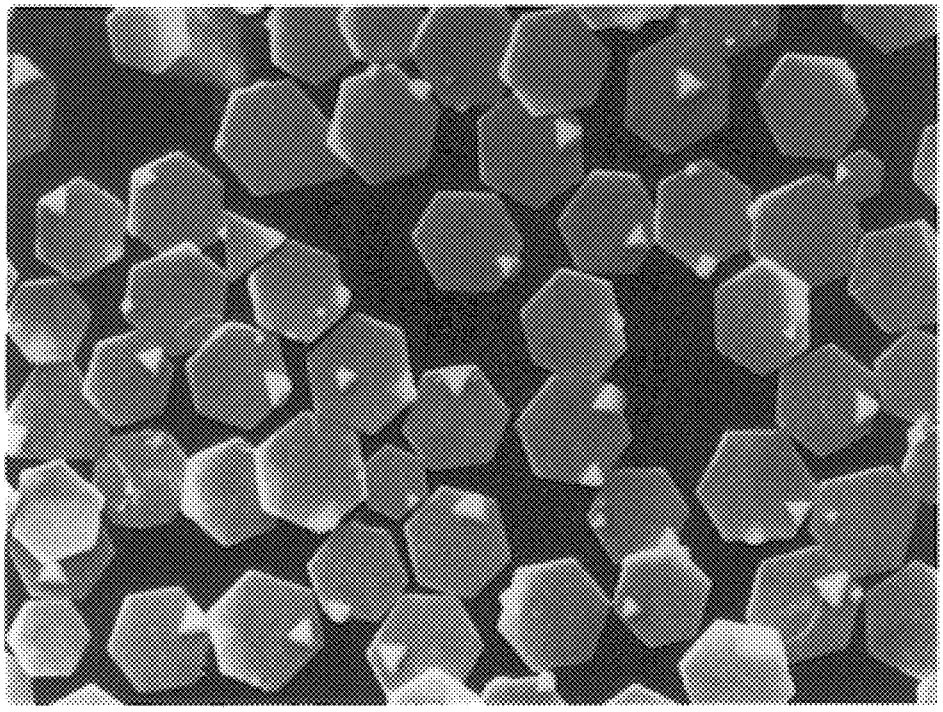
FIG. 1 is a photomicrograph of an emulsion according to the invention.

The emulsions of the present invention contain high bromide {111} tabular grains serving as host grains for silver halide epitaxy. In a preferred form of the invention the host gains can be provided by any conventional silver bromide {111} tabular grain emulsion. Whereas camera speed emulsions that lack epitaxy normally rely on iodide in high bromide grains to increase speed, the role of epitaxy in grain sensitization can eliminate any necessity of employing iodide to increase imaging sensitivity. Reducing or eliminating iodide increases development rates.

Iodide in the host tabular grains can be useful to increase blue light absorption and/or to enhance interimage effects. When iodide is incorporated in the host grains, it is uniformly distributed over the major faces of the tabular grains. Further, iodide is limited to less than 7 mole percent in the surface regions of the grains—that is, within the portion of the grains nearest the surface that account for 40 percent of total silver forming the grains. The interior of the grains can contain any convenient conventional concentration of iodide, up to the saturation limit of iodide, which is typically taken as 40 mole percent, based on silver. It is often advantageous to form a tabular grain core that contains little or no iodide, followed by the deposition of a high iodide shell before depositing the surface region. In this form, the highest iodide concentrations appear in the host tabular grains as a buried or sub-surface shell. In most instances overall iodide concentrations of the host tabular grains are less than 20 mole percent, usually less than 10 mole percent.

In addition to silver bromide and silver iodobromide host tabular grains, it is possible to incorporate chloride in the host tabular grains. Silver chloride concentrations are preferably limited to less than 30 mole percent and optimally less than 10 mole percent, based on total silver. Silver chlorobromide, silver iodochlorobromide and silver chloroiodobromide host tabular grains are contemplated.

Host high bromide {111} tabular grain emulsions can be prepared by conventional techniques employing or modified to employ halide compositions satisfying the description above. The teachings of the following patents, here incorporated by reference:

List HT

Daubendiek et al U.S. Pat. No. 4,414,310;
Abbott et al U.S. Pat. No. 4,425,426;
Wilgus et al U.S. Pat. No. 4,434,226;
Kofron et al U.S. Pat. No. 4,439,520;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927;
Maskasky U.S. Pat. No. 5,604,085;
Reed et al U.S. Pat. No. 5,604,086;
Maskasky U.S. Pat. No. 5,620,840;
Maskasky U.S. Pat. No. 5,667,955;
Maskasky U.S. Pat. No. 5,691,131;
Maskasky U.S. Pat. No. 5,693,459;
Jagannathan et al U.S. Pat. No. 5,723,278;
Maskasky U.S. Pat. No. 5,733,718;
Jagannathan et al U.S. Pat. No. 5,736,312;
Antoniades et al U.S. Pat. No. 5,750,326;
Brust et al U.S. Pat. No. 5,763,151; and
Maskasky et al U.S. Pat. No. 5,792,602.

Contemplated high bromide {111} tabular grain emulsions are those in which the {111} tabular grains account for greater than 50 percent, preferably at least 70 and optimally at least 90 percent, of total grain projected area. High bromide emulsions in which {111} tabular grains account for substantially all (>97%) of total grain projected area are disclosed in the patents of List HT cited above and are specifically contemplated. The {111} tabular grains preferably have an average thickness of less than 0.3 $\mu$m and most preferably less than 0.2 $\mu$m. It is specifically contemplated to employ ultrathin tabular grain emulsions in which the tabular grains having an average thickness of less than 0.07 $\mu$m account for greater than 50 percent of total grain projected area. When tabular grain emulsions are relied upon for latent image formation in the blue recording layer unit, they can have the thickness characteristics noted above. However, to increase speed by absorption of blue light (native absorption) within the grains, it is recognized that the tabular grains having a thickness of up to 0.50 $\mu$m can account for at least 50 percent of total grain projected area in the blue recording layer units.

The high bromide {111} tabular grains preferably have an average aspect ratio of at least 5, most preferably greater than 8. Average aspect ratios can range up to 100 or higher, but are typically in the range of from 12 to 60. The average ECD of the latent image forming emulsions is typically less than 10 μm, with mean ECD's of less than 6 μm being particularly preferred to maintain low levels of granularity.

Greater than 50 percent, preferably greater than 70 percent, and optimally greater than 80 percent, of the tabular grains contain silver halide epitaxy at a single site on the grain. Any amount of the silver halide epitaxy sufficient to provide the required number of epitaxy sites can be employed. It is preferred that the silver halide epitaxy account for at least 0.05 mole percent of total silver, where total silver includes that in the host and the epitaxy. Preferably the epitaxy is limited to 50 percent or less of the total silver. Generally silver halide epitaxy concentrations are from 0.3 to 25 mole percent, based on total silver, with concentrations of from about 0.5 to 15 mole percent, based on total silver, being generally preferred.

The silver halide epitaxy contains at least a 10 mole percent chloride, based on silver (in the epitaxy only). Thus, when silver bromide and silver iodobromide host grains are employed, the silver halide epitaxy contains at least 10 mole percent chloride, based on silver. When chloride is also present in the host grains, it is contemplated to adjust the chloride content of the epitaxy so that it is at least 10 mole percent higher, based on silver in the epitaxy than the chloride content of the host grains. In one specifically contemplated form, silver and chloride salts can be reacted to form the silver halide epitaxy. The resulting epitaxy can consist essentially of silver chloride, with minor, if any, incorporations of other halides present in the dispersing medium of the host tabular grain emulsion. If desired, bromide and/or iodide ions can be incorporated in the silver halide epitaxy. Deaton et al U.S. Pat. No. 5,582,965, the disclosure of which is here incorporated by reference, teaches improvement in performance to be attributable to incorporating iodide ions along with chloride ions in the epitaxy. When bromide ions are also incorporated, the compatibility of iodide ions with the silver chloride crystal lattice structure is increased, allowing higher concentrations of iodide ion to be incorporated. For example, Deaton et al discloses that precipitation of silver halide epitaxy by introducing Cl:Br:I in a 42%:42%:16% molar ratio results in an iodide incorporation in the epitaxy of 7.1 mole percent, based on the silver in the epitaxy. Preferred iodide incorporations in the epitaxy range from 1 to 15 mole percent (most preferably 2 to 10 mole percent) based on silver in the epitaxy.

Location of the silver halide epitaxy at a single site on the host tabular grains as opposed to its location at numerous sites, as disclosed by Maskasky U.S. Pat. No. 4,435,501, Levy U.S. Pat. No. 5,612,177, Daubendiek et al U.S. Pat. Nos. 5,494,789, 5,503,971 and 5,576,168, Deaton et al U.S. Pat. No. 5,582,965, and Eshelman et al U.S. Pat. Nos. 5,612,175, 5,612,176 and 5,614,359, cited above and here incorporated by reference to show conventional silver halide epitaxy features shared with this invention, lies in shifting precipitation conditions to reduce the rate of precipitation. By lowering the rate of precipitation, further silver halide precipitation, after a single deposition site is formed on a host grain, favors precipitation at the existing epitaxy site over forming additional precipitation sites. In other words, silver halide epitaxy deposition is balanced closer to equilibrium (lower supersaturation) conditions than the epitaxy precipitations taught by the epitaxy citations above.

Location of the silver halide epitaxy to contact an edge region of the host grains is realized by controlling surface iodide as noted above. Employing uniform surface iodide and limiting surface region iodide to less than 7 mole percent, preferably less than 5 mole percent, based on silver in the surface regions runs counter to the common practices of the art. Specifically, the present invention does not rely on the higher iodide surface concentrations taught in the art for directing silver halide epitaxy. For example, Maskasky U.S. Pat. No. 4,435,501 teaches to employ iodide concentrations of at least 8 mole percent, based on silver, to direct silver halide epitaxy. Additionally, also contrary to the common practice of the art, it is not contemplated to adsorb spectral sensitizing dye to the surfaces of the host tabular grains prior to conducting silver halide epitaxial deposition. By eliminating any dependence on spectral sensitizing dyes to direct epitaxy, a much broader selection of conventional spectral sensitizing dyes becomes available for use in the emulsions of the invention. Further, it is possible to defer spectral sensitizing dye until after grain formation has been completed and, if desired, until after chemical sensitization has been completed. Thus, the present invention offers more flexibility in the preparation of high bromide {111} tabular grain emulsions employing silver halide epitaxy to increase sensitivity.

Addition of the silver halide epitaxy alone significantly increases the sensitivity of the resulting tabular grain emulsions. However, maximum sensitivities are realized when the silver halide epitaxy is combined with subsequent conventional chemical and spectral sensitizations. The high bromide {111} tabular grain emulsions with silver salt epitaxy arc preferably chemically sensitized as disclosed in *Research Disclosure*, Vol. 389, September 1996, Item 38957. IV. Chemical sensitization. Middle chalcogen (i.e., sulfur, selenium and tellurium) and noble metal (e.g., gold) chemical sensitizations are preferred. Kofron et al U.S. Pat. No. 4,439,520, here incorporated by reference.

A specifically preferred approach to silver halide epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

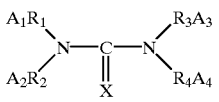

(I)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(II)}$$

wherein

L is a mesoionic compound;

X is an anion; and $L^1$ is a Lewis acid donor.

It has been discovered that the emulsions of the invention are less susceptible to desensitization by spectral sensitizing dye than conventional high bromide {111} tabular grain emulsions with epitaxy. When an emulsion is intended to be exposed to light outside its spectral region of native silver halide sensitivity, such as exposure to green or red light, the emulsion exhibits little or no measurable speed when exposed to green or red light in the absence of a spectral sensitizing dye. The adsorption of a green or red absorbing spectral sensitizing dye to the grain surfaces dramatically increases the sensitivity of the emulsion in this spectral region. This does not mean, however, that the dye has not also desensitized the emulsion. If the speeds of the emulsion in a spectral region of native sensitivity (e.g., the near ultraviolet) with and without spectral sensitizing dye are compared, often the intrinsic speed of the emulsion has been reduced by the addition of spectral sensitizing dye. This loss of intrinsic speed also indicates that all of the potentially available speed increase in the spectral region of spectral sensitization has not been realized. Surprisingly, the emulsions of the invention exhibit lower dye desensitization and higher speeds in both the spectral regions of intrinsic sensitivity and spectral sensitization.

Spectral sensitization can be undertaken in the practice of the present invention during or following chemical sensitization. Spectral sensitization prior to completing formation of the silver halide epitaxy is not contemplated. Useful spectral sensitizing dyes are disclosed in *Research Disclosure*, Item 38957, V. Spectral sensitization and desensitization, A.

Sensitizing dyes.

In addition to the sensitized silver halide grains, the emulsions of the invention additionally contain an aqueous dispersing medium for the grains. The dispersing medium contains a peptizer for the silver halide grains. Preferred peptizers are gelatin and gelatin derivatives, such as phthalated and acetylated gelatin. When the emulsions are incorporated into photographic elements, additional vehicle and related addenda are commonly added. Peptizers, vehicles and related addenda are summarized in *Research Disclosure*, Item 38957, II Vehicles, vehicle extenders, vehicle-like addenda and vehicle related addenda.

It is additionally contemplated to employ cationic starch as a peptizer. The use of cationic starch as a peptizer for the precipitation of high bromide {111} tabular grain emulsions is taught by Maskasky U.S. Pat. Nos. 5,604,085, 5,620,840, 5,667,955, 5,691,131 and 5,733,718. Oxidized cationic starches are advantageous in exhibiting lower levels of viscosity than gelatino-peptizers. This facilitates mixing. Under comparable levels of chemical sensitization high photographic speeds can be realized using cationic starch peptizers. Alternatively, speeds equal to those obtained using gelatino-peptizers can be achieved at lower precipitation and/or sensitization temperatures, thereby avoiding unwanted grain ripening.

Apart from the features described above, the emulsions of the invention can take any convenient conventional form and can be incorporated into photographic and radiographic elements for use in forming a developable latent image. All of the patents cited above in the HT list incorporated by reference above disclose emulsion and imaging element features compatible with the emulsions of the invention and their use. Other conventional imaging element features (including addenda and support elements) as well as conventional exposures and processing are summarized in *Research Disclosure*, Item 38957.

EXAMPLES

Example Emulsion A

This example demonstrates the precipitation of a silver iodochlorobromide tabular grain emulsion with the silver chloride confined in most grains to a single deposition site on the major face of and contacting an edge region of the predominantly iodobromide tabular emulsion grains.

An 18 liter reaction vessel was charged with an aqueous solution consisting of 4.4589 Kg of water, 4.50 g (1.0 g/L) of alkali-processed low (<5 micromoles per gram) methionine gelatin, 5.56 g (1.235 g/L) of sodium bromide, 1.56 g of a 70.8 wt % methanolic solution of Pluronic 31R1™ surfactant (61.9 wt % based on total silver used in nucleation), and 18.5 g of 4.0 M nitric acid. At 45° C. and with vigorous stirring, 65.1 mL of a 0.50 M silver nitrate solution (5.53 g of silver nitrate) were added over 1 minute followed by a 1 minute hold. After the hold, 25.5 mL of 3.5 M sodium bromide (9.18 g of sodium bromide) were added over 1 minute followed again by a 1 minute hold. The temperature was then increased to 60° C. over a period of 9 minutes. After 7 minutes of this temperature ramp 39.82 g of a 3.74 M ammonium sulfate solution was added. At the completion of the temperature ramp, 125.3 g of 2.5 M sodium hydroxide were added and the solution was held for 9 minutes. Following the hold, a 1.5 liter solution containing 150 g of alkali processed low methionine gelatin, 30.29 g of citric acid, 87.6 g of a 2.5 M sodium hydroxide solution, and 0.26 g of the 70.8% methanolic solution of Pluronic 31R1 was added and held for 3 minutes. After the hold, 65.3 mL of 3.5 M NaBr were added over 4.5 min followed by a 1.4 minute hold. Afterward, a 0.50 M silver nitrate solution was added using a linearly increasing flow rates from 14.5 to 60.1 mL/min over 10.4 minutes. This was followed by a 1 minute hold. The linearly increasing flow of 0.5 M silver nitrate was then continued from 60.1 mL/min to 85.1 mL/min over 15.8 min with the 3.5 M sodium bromide solution added at approximately 9.2 to 13.0 mL/min to maintain a constant excess halide level. Then a 3.5 M silver nitrate solution was added with linearly increasing flow rates from 12.4 to 67.5 mL/min over 71.24 min simultaneously with a 3.5 M sodium bromide solution ramped from approximately 12.9 mL/min to 68.8 mL/min to maintain a constant excess halide level. The addition of 3.5 M silver nitrate was then continued at 67.6 mL/min for 13.72 minutes with the 3.5 M sodium bromide added to maintain a constant excess halide level. This completed formation of the high bromide {111} tabular grains.

To begin formation of high chloride silver halide epitaxy, the emulsion was held for 10 minutes during which 272.7 g of a 35% by weight water swollen gel were added and allowed to dissolve. This was followed by a temperature ramp to 40° C. over 20 minutes. This was followed by the addition of 380.2 g of a 3.674 M sodium chloride solution during a 1 minute hold. The 3.5 M silver nitrate was then added at 50 mL/min for 2.5 minutes followed by the addition of a 0.38 M potassium iodide solution at 30.5 mL/min for 10 minutes. An amount of 33.82 g of a 3.5 g/L solution of potassium hexacyanoruthenate was then added over 1 minute. This was followed by the addition of 262.1 mL of 3.5 M silver nitrate over 10 minutes. Additional sodium chloride was then added and the emulsion was washed and concentrated by ultrafiltration followed by the addition of 385 g of bone gelatin for storage.

The resulting high bromide {111} tabular emulsion had an average grain ECD of 2.5 μm and an average grain thickness of 0.122 μm. Greater than 80% of the grain population was present in the form of tabular grains with {111} major faces. Greater than 70 percent of the tabular grains exhibited high chloride silver halide epitaxy at a single site on the grain contacting an edge region of the host grain. A representative grain sample is shown in FIG. 1.

Comparative Emulsion B

This example demonstrates the precipitation of a silver iodochlorobromide {111} tabular grain emulsion with high chloride silver halide epitaxy confined primarily to a single deposition site centered in the middle of a major face of the silver iodobromide {111} tabular emulsion host grains.

An 18 liter reaction vessel was charged with an aqueous solution consisting of 4,542.6 g of water, 18.40 g of alkali-processed low methionine gelatin, 32.2 g of sodium bromide, and 0.65 ml of a non-interacting antifoamant. At 62° C. and with vigorous stirring, 525 mL of a 0.42 M silver nitrate solution were added over 15 minutes followed by a 1 minute hold where 75 mL of a 141.4 g/L solution of ammonium sulfate was added. This was followed by a five minute hold where 152 mL of a 2.5 M sodium hydroxide solution was added. After the five minute hold, 150 mL of a 2.5 M nitric acid solution was added over 1 minute. Following the hold, a 3.0 liter solution containing 222 g of alkali processed low methionine gelatin, 11.35 g of sodium bromide, and 0.50 mL of the non-interacting antifoamant were added and held for 5 minutes. After the hold, a 3.0 M silver nitrate solution and a mixed salt solution containing 2.91 M sodium bromide and 0.09 M potassium iodide were added using a linearly increasing flow rate of from 7.3 to 22.0 mL per minute over 15 minutes. The same solutions were then added using linearly increasing flow rates from 22.0 to 53.0 mL/min over 10 minutes then from 53.0 to 98.0 mL/min over 10 minutes then from 98 to 214 mL/min over 14.0 minutes. Slight variation was allowed in the salt solution flow rates to maintain a constant pAg.

To begin formation of high chloride silver halide epitaxy, the emulsion was held for 10 minutes during which 100 g of lime processed bone gelatin were added and allowed to dissolve. This was followed by a temperature ramp to 40° C. over 20 minutes. This was followed by the addition of 58.44 g of sodium chloride dissolved in 344.0 g of water during a 1 minute hold. The 3.0 M silver nitrate was then added at 40 mL/min simultaneously with a 0.28 M potassium iodide solution run at 12. 9 mL/min for 8.3 minutes. 52.6 mL of a 3.5 g/L solution of potassium hexacyanoruthenate was then added over 1 minute. This was followed by the addition of 125.5 ml of 3.0 M silver nitrate over 5 minutes. Additional sodium chloride was then added and the emulsion was washed and concentrated by ultrafiltration followed by the addition of 247 g of bone gelatin for storage.

Figure 2:
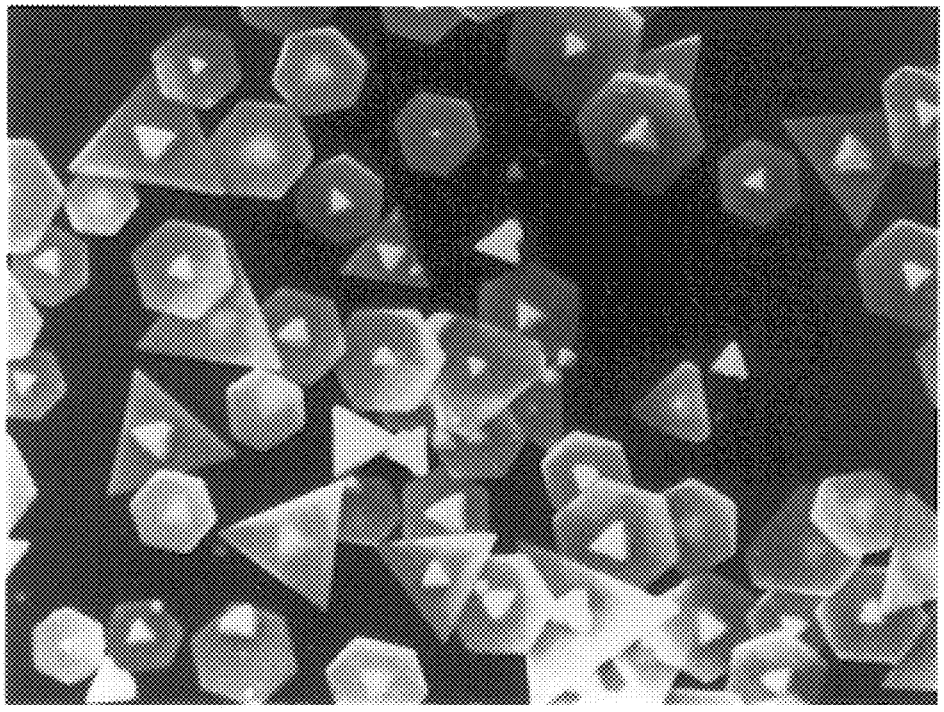
FIG. 2 is a photomicrograph of a comparative emulsion.

The resulting high bromide {111} tabular emulsion had an average grain ECD of 2.7 μm and an average grain thickness of 0.125 μm. At least 90% of the grain population was composed of high bromide {111} tabular grains with a single high chloride silver halide epitaxy site formed in the center the major {111} face of the tabular grains. A representative grain sample is shown in FIG. 2.

Sensitization and Photographic Evaluation

Emulsions A and B were chemically sensitized as follows: To a quantity of emulsion melted at 40° C. were added 120 mg/mole of sodium thiocyanate followed optimum levels of 3-carboxymethyl-1,3,3-trimethyl-2-thiourea sodium salt and aurous bis(1,4,5-trimethyl-1,2,4-triazolium-3-thiolate) tetrafluoroborate. benzothiazolium tetrafluoroborate salt were also added as a finish modifier. The emulsion was heated to 60° C. and held for 10 minutes then chilled rapidly to 40° C. followed by the addition of 75 mg/mole of 1-(3-acetamidophenyl)-5-mercaptotetrazole.

Portions of Emulsions A and B were spectrally sensitized by modifying the above chemical sensitization by adding 0.655 mmole per Ag mole of sensitizing dye A, anhydro-5-chloro-9-ethyl-5'-phenyl-3'-(3-sulfobutyl)-3-(3-sulfopropyl)-oxacarbocyanine hydroxide, sodium salt followed by a 10 min hold and 0.145 mmol per Ag mole of sensitizing dye B, anhydro-3,9-diethyl-3'-methylsulfanylcarbamoylmethyl-5-phenyloxacarbocyanine hydroxide, followed by a 10 minute hold before the addition of the sulfur and gold releasing chemical sensitizers.

The emulsions were coated in a single layer coating at 12.91 mg/dm$^2$ and total gel level at 26.9 mg/dm$^2$. The antifoggant 4-hydroxy-6-methyl-1,3,3a, 7-tetraazaindene in the amount of 1.75 g per mole was also added during coating. An overcoat of 32.28 mg/dm$^2$ of gel and surfactants was coated on top of the emulsion, and the entire layer was hardened with bis(vinylsulfonyl-methyl)ether.

The coatings of emulsion with chemical sensitization only were exposed through a step wedge for 0.01 sec to a 365 nm line source. The coatings of emulsion with chemical and spectral sensitization were exposed through a step wedge for 0.01 sec with a Daylight V source filtered with a Wratten™ 9 (transmission >460 nm) and a 0.6 neutral density Inconel filter. The exposed coatings were processed in the Kodak Flexicolor™ C41 color negative process. The cyan image dye density was read using status M filtration.

The speed was measured at a toe density Ds where Ds minus Dmin equal 20 percent of the slope of a line drawn between Ds and a point D' on the characteristic curve offset from Ds by 0.6 log E, where E represents exposure in lux-seconds. Speed is reported in relative log units, where a speed difference of 30 equals a difference of 0.3 log E.

TABLE I

| Emulsion | Dyed 365-Line Speed | Un-dyed 365-Line Speed | Dyed vs Un-dyed Speed Difference | Dyed Wratten ™ 9 Speed |
|---|---|---|---|---|
| A (example) | 100 | 106 | −6 | 100 |
| B (comparison) | 68 | 120 | −52 | 65 |

Table I compares the speeds of the example and comparison emulsions both with (dyed) and without (un-dyed) spectral sensitizing dye. Notice that the intrinsic or 365 line speed of the dyed example emulsion is about the same speed as the un-dyed sensitization of emulsion A. In contrast, the speed difference between un-dyed and dyed sensitizations for the emulsion B is over 0.5 log E. This loss of intrinsic sensitivity for the comparison emulsion causes it to be much slower for spectral or minus-blue (Wratten™ 9) exposures even though its grain size is at least as large as the example emulsion. Clearly the example emulsion was superior in terms of imaging sensitivity.

The invention has been described in detail with particular reference to certain preferred embodiments thereof, but it will be understood that variations and modifications can be effected within the spirit and scope of the invention.

What is claimed is:

1. An emulsion comprised of high bromide silver halide grains and a dispersing medium, tabular silver halide grains having {111} major faces accounting for greater than 50 percent of total grain projected area, any iodide at the major faces of the tabular grains being uniformly distributed and any iodide in a surface region accounting for 40 percent of total silver amounting to less than 7 mole percent, based on silver in the surface region, greater than 50 percent of the tabular grains serving as a host for silver halide epitaxy at a single site on a major face of the host tabular grains, the silver halide epitaxy contains a chloride content that is at least 10 mole percent higher than that of the host tabular grains, and greater than 50 percent of the silver halide epitaxy sites contacting an edge region of the host tabular grains.

2. An emulsion according to claim 1 wherein spectral sensitizing dye is adsorbed on the major faces of the tabular silver halide grains.

3. An emulsion according to claim 1 wherein one or a combination of chemical sensitizers chosen from among sulfur, selenium, tellurium and gold sensitizers.

4. An emulsion according to claim 1 wherein the tabular grains account for greater than 70 percent of total grain projected area.

5. An emulsion according to claim 1 wherein greater than 70 percent of the epitaxy sites contact an edge region of the host tabular grains.

6. An emulsion according to claim 1 wherein the silver halide forming the epitaxy is a high chloride silver halide.

7. An emulsion according to claim 6 wherein the high chloride silver halide epitaxy additionally contains iodide.

8. An emulsion according to claim 1 wherein greater than 70 percent of the tabular grains serve as a host for silver halide epitaxy at a single site.

9. An emulsion according to claim 1 wherein the host tabular grains are silver bromide grains.

10. An emulsion according to claim 1 wherein the host tabular grains contain a uniform distribution of iodide throughout.

11. An emulsion according to claim 1, wherein the silver halide epitaxy has been formed in the absence of spectral sensitizing dyes absorbed to the surfaces of the host tabular grains.

12. An emulsion according to claim 2, wherein the spectral sensitizing dye is adsorbed on the major faces of the tabular silver halide grains after the silver halide epitaxy has been formed.

* * * * *